US011222654B2

(12) United States Patent
Ganor et al.

(10) Patent No.: US 11,222,654 B2
(45) Date of Patent: Jan. 11, 2022

(54) VOICE DETECTION

(71) Applicant: DSP Group Ltd., Herzliya (IL)

(72) Inventors: Assaf Ganor, Herzelia (IL); Ori Elyada, Herzliya (IL)

(73) Assignee: DSP GROUP LTD., Herzliya (IL)

( * ) Notice: Subject to any disclaimer, the term of this patent is extended or adjusted under 35 U.S.C. 154(b) by 17 days.

(21) Appl. No.: 16/740,795

(22) Filed: Jan. 13, 2020

(65) Prior Publication Data

US 2020/0273486 A1 Aug. 27, 2020

Related U.S. Application Data

(60) Provisional application No. 62/791,892, filed on Jan. 14, 2019.

(51) Int. Cl.
*G10L 25/84* (2013.01)
*G10K 11/178* (2006.01)

(52) U.S. Cl.
CPC ..... *G10L 25/84* (2013.01); *G10K 11/178* (2013.01)

(58) Field of Classification Search
CPC ..... G10L 25/84; G10L 25/78; G10L 15/20; G10L 21/0208; G10L 21/0216; G10K 11/178; G10K 11/1781; G10K 11/17823; G10K 11/17827; G10K 11/17833; G10K 11/17817; G10K 11/17885; G10K 11/17875; G10K 2210/1081
See application file for complete search history.

(56) References Cited

U.S. PATENT DOCUMENTS

2010/0131269 A1* 5/2010 Park ..... G10K 11/17837 704/233
2019/0214036 A1* 7/2019 Wurtz ..... G10L 15/20

* cited by examiner

*Primary Examiner* — Yogeshkumar Patel
(74) *Attorney, Agent, or Firm* — Reches Patents

(57) ABSTRACT

A method for voice detection, the method may include (a) generating an in-ear signal that represents a signal sensed by an in-ear microphone and fed to a feedback active noise cancellation (ANC) circuit; (b) generating at least one additional signal, based on at least one out of a playback signal and a pickup signal sensed by a voice pickup microphone; and (c) generating a voice indicator based on the in-ear signal and the at least one additional signal.

22 Claims, 4 Drawing Sheets

100

300

VOICE DETECTION

BACKGROUND OF THE INVENTION

User devices may include one or more microphones that detect desired signals as well as ambient noise. When the user speaks, voice signals that are indicative of the speech may also be detected by these one or more microphones.

There is a growing need to provide a device and method for detecting these voice signals.

SUMMARY

There may be provided a method for voice detection, the method may include generating an in-ear signal that represents a signal sensed by an in-ear microphone and fed to a feedback active noise cancellation (ANC) circuit; generating at least one additional signal, based on at least one out of a playback signal and a pickup signal sensed by a voice pickup microphone; and generating a voice indicator based on the in-ear signal and the at least one additional signal.

There may be provided a non-transitory computer readable medium that stores instructions for: generating an in-ear signal that represents a signal sensed by an in-ear microphone and fed to a feedback active noise cancellation (ANC) circuit; generating at least one additional signal, based on at least one out of a playback signal and a pickup signal sensed by a voice pickup microphone; and generating a voice indicator based on the in-ear signal and the at least one additional signal.

There may be provided a device for voice detection, the device may include an in-ear microphone; a feedback active noise cancellation (ANC) circuit; a voice pickup microphone; a processing unit that is configured to generate an in-ear signal that represents a signal sensed by the in-ear microphone and fed to the feedback ANC circuit; and at least one other processing unit that is configured to: generate at least one additional signal, based on at least one out of a playback signal and a pickup signal sensed by a voice pickup microphone; and generate a voice indicator based on the in-ear signal and the at least one additional signal.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE DRAWINGS

Figure 1:
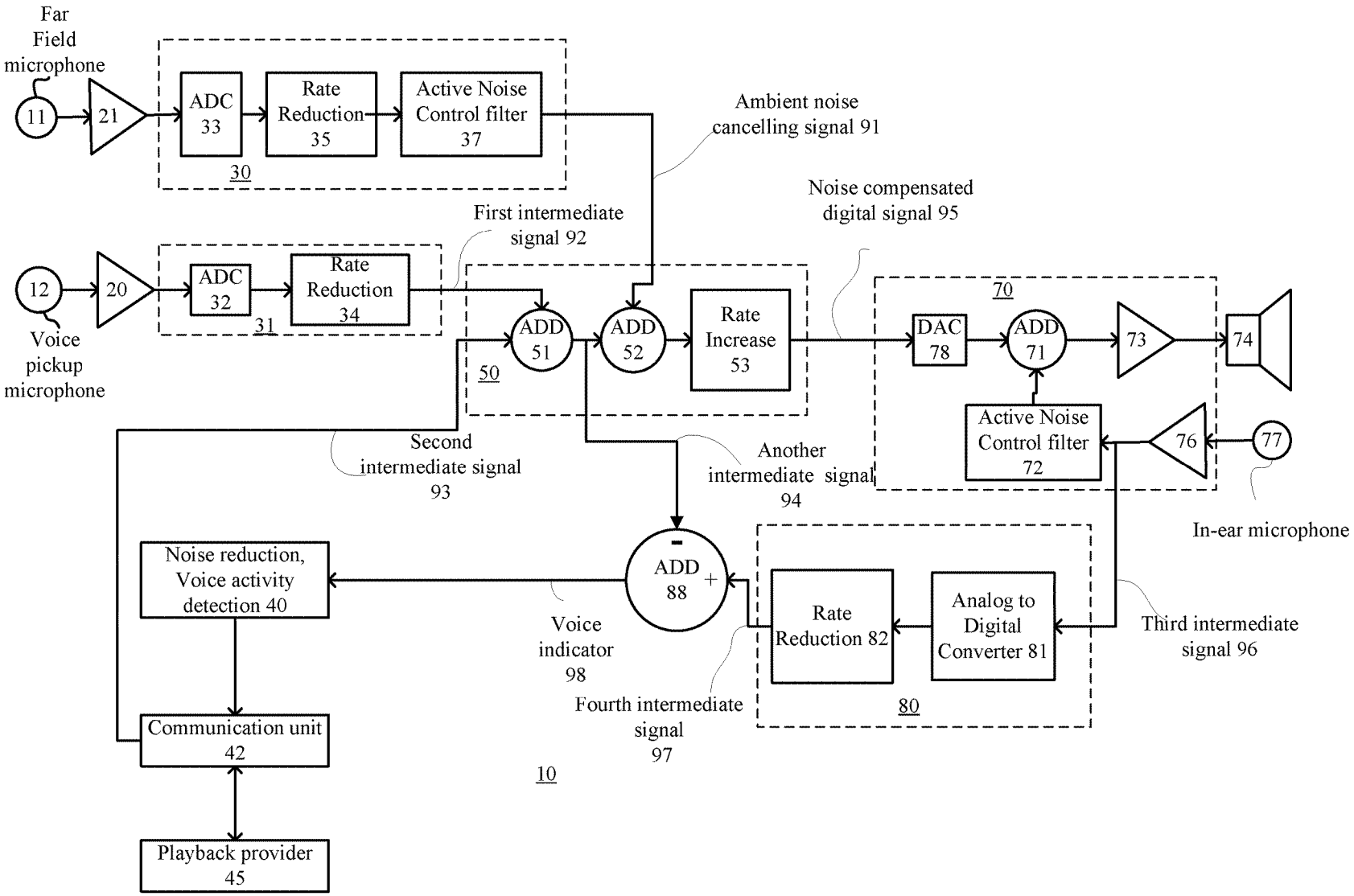
FIG. 1 illustrates a device according to an embodiment of the invention.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater ex tent than that considered necessary as illustrated above, for the understanding and appreciation of the underlying concepts of the present invention and in order not to obfuscate or distract from the teachings of the present invention.

According to an embodiment of the invention there is provided a device and method for detecting voice.

Any reference to a device should be applied, mutatis mutandis to a method that is executed by a device and/or to a non-transitory computer readable medium that stores instructions that once executed by the device will cause the device to execute the method.

Any reference to method should be applied, mutatis mutandis to a device that is configured to execute the method and/or to a non-transitory computer readable medium that stores instructions that once executed by the device will cause the device to execute the method.

Any reference to a non-transitory computer readable medium should be applied, mutatis mutandis to a method that is executed by a device and/or a device that is configured to execute the instructions stored in the non-transitory computer readable medium.

The term "and/or" is additionally or alternatively.

FIG. 1 illustrates an example of a device 10.

It should be noted that the device includes few rate reduction units and a rate increase unit. These units perform various rate changes in order to compensate for different rates that are required for different purposes—such as transmission, voice processing, conversions between the digital domain and the analog domain, and the like.

ADC stands for analog to digital converter.

DAC stands for digital to analog converter.

ANC stands for active noise cancellation.

VAD stands for voice activity detector.

ADD stands for adder.

Device 10 includes far field microphone 11, first amplifier 21, first ADC 33, first rate reduction unit 35, first ANC filter 37, voice pickup microphone 12, second amplifier 20, second ADC 32, second rate reduction unit 34, communication unit 42, playback provider 45, noise reduction and/or voice activity detector (VAD) unit 40, first adder 51, second adder 52, rate increase unit 53, third adder 71, third amplifier 73, second ANC filter 72, fourth amplifier 76, speaker 74, in-ear microphone 77, third ADC 81, third rate reduction unit 82 and fourth adder 88.

A sequence of first ADC 33, first rate reduction unit 35, and first ANC filter 37 is included in a first processing unit 30.

A sequence of second ADC 32, and second rate reduction unit 34 is included in a second processing unit 31.

A sequence of first adder 51, second adder 52, and rate increase unit 53 is included in a playback unit 50.

Feedback ANC unit 70 includes third adder 71, third amplifier 73, second ANC filter 72, and fourth amplifier 76.

Third processing unit 80 includes a sequence of third ADC 81 and third rate reduction unit 82.

The input of first amplifier 21 is coupled to the far field microphone 11. The output of the first amplifier 21 is coupled to an input of first processing unit 30. The first processing unit 30 outputs to an input of second adder 52 an ambient noise cancellation signal 91.

The input of second amplifier 20 is coupled to the voice pickup microphone 12. The output of the second amplifier 20 is coupled to an input of the second processing unit 31. The second processing unit 31 outputs to an input of first adder 51 a first intermediate signal 92. When the user speaks this is mainly a voice signal.

Communication unit 42 may communicate with other devices (such as a desired input signal—playback signal—from playback provider 45 that may be a a music provider, a voice over IP provider, and the like) and may output a second intermediate signal 93 to first adder 51.

The communication unit 42 may support one or more control and/or communication protocols such as but not limited to electrical serial bus interface standard $I^2S$, $I^2C$, USB, Bluetooth, SPI, TDM, PDM, PCM.

An output of the first adder 51 is coupled to an input of the second adder 52. The output signal of the second adder 52 may be fed to rate increase unit 53. The output signal of first adder 51 (another intermediate signal 94) is fed to a subtraction input (−) of fourth adder 88.

The rate increase unit 53 outputs a noise compensated digital signal to a digital to analog converter (DAC) 78 that is followed by third adder 71 of feedback ANC unit 70.

The third adder 71 also receives an an output signal of second ANC filter 72.

The output of the third adder 71 is coupled to the input of third amplifier 73. The output of third amplifier 73 is coupled to speaker 74.

In-ear microphone 77 senses signals within the ear of the user. Within the ear of the user, the voice generated by the user is much stronger than the ambient noise. The output of the in-ear microphone 77 is fed to fourth amplifier 76.

The in-ear amplifier 76 outputs a third intermediate signal 96 that is fed to (a) an input of the third processing unit 80, and to (b) second ANC filter 72.

When the user speaks the third intermediate signal 96 includes a highly attenuated in-ear ambient noise and strong in-ear voice signal.

The third intermediate signal 96 is processed (analog to digital conversion and rate reduction) by the third processing unit 80 to provide a fourth intermediate signal 97 that is fed to an adding input (+) of fourth adder 88.

The fourth adder 88 subtracts the another intermediate signal 94 from the fourth intermediate signal 97 to provide voice indicator 98.

When the user speaks, the fourth intermediate signal 97 includes a voice signal that is much stronger than the voice signal within the another intermediate signal 94. Other components of another intermediate signal 94 and fourth intermediate signal 97 virtually cancel each other by the subtraction made by fourth adder 88.

The voice indicator 98 may be fed to any unit that may use such an indicator such as a voice activity detection unit, a noise reduction unit, and the like.

The voice activity detection unit may check the voice indicator (for example whether its amplitude and/or power and/or energy exceeds a threshold) and may, when a voice is detected, respond to the detection. The response may include initiating a speech recognition process, wakeup a speech recognition circuit, alert one or more other units, and the like.

The device may generate the voice detection signal by using, at least in part, units such as third processing unit and in ear microphone that already exist in ANC devices—thus reducing the cost of the device.

Figure 2:
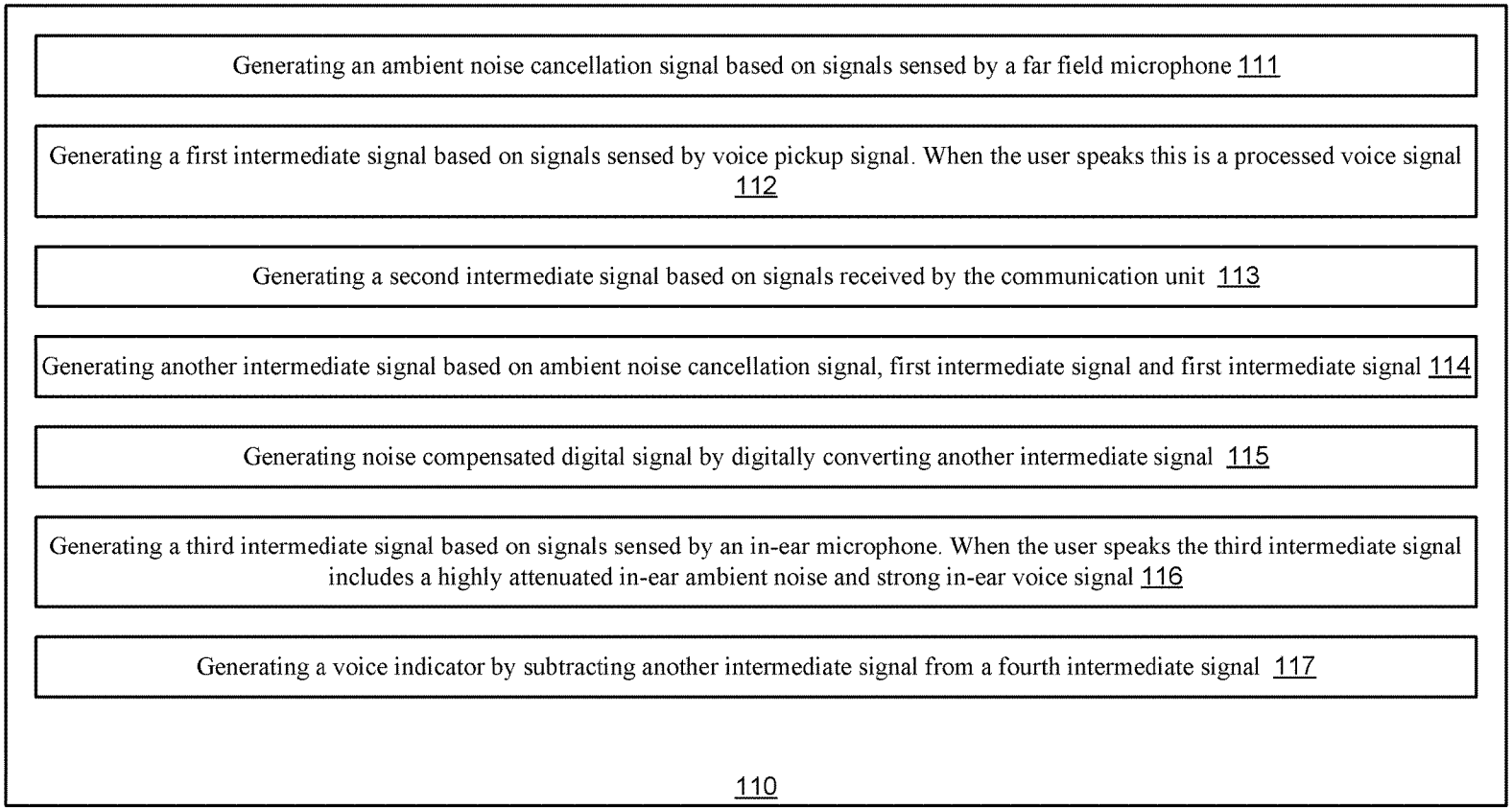
FIG. 2 illustrates a method according to an embodiment of the invention.

FIG. 2 illustrates an example of method 100.

Method 100 may include step 110 of operating the device of FIG. 1 to detect voice of a user.

Step 110 may include:

a. Generating an ambient noise cancellation signal 91 based on signals sensed by a far field microphone. Step 111.

b. Generating a first intermediate signal 92 based on signals sensed by voice pickup signal. When the user speaks this is a processed voice signal. Step 112.

c. Generating a second intermediate signal 93 based on signals received by the communication unit 42. Step 113.

d. Generating another intermediate signal 94 based on ambient noise cancellation signal 91, first intermediate signal 92 and second intermediate signal 93. Step 114.

e. Generating noise compensated digital signal 95 by digitally converting another intermediate signal 94. Step 115.

f. Generating a third intermediate signal 96 based on signals sensed by an in-ear microphone. When the user speaks the third intermediate signal 96 includes a highly attenuated in-ear ambient noise and strong in-ear voice signal. Step 116.

g. Generating a voice indicator 98 by subtracting another intermediate signal 94 from a fourth intermediate signal 97. Step 117.

Figure 3:
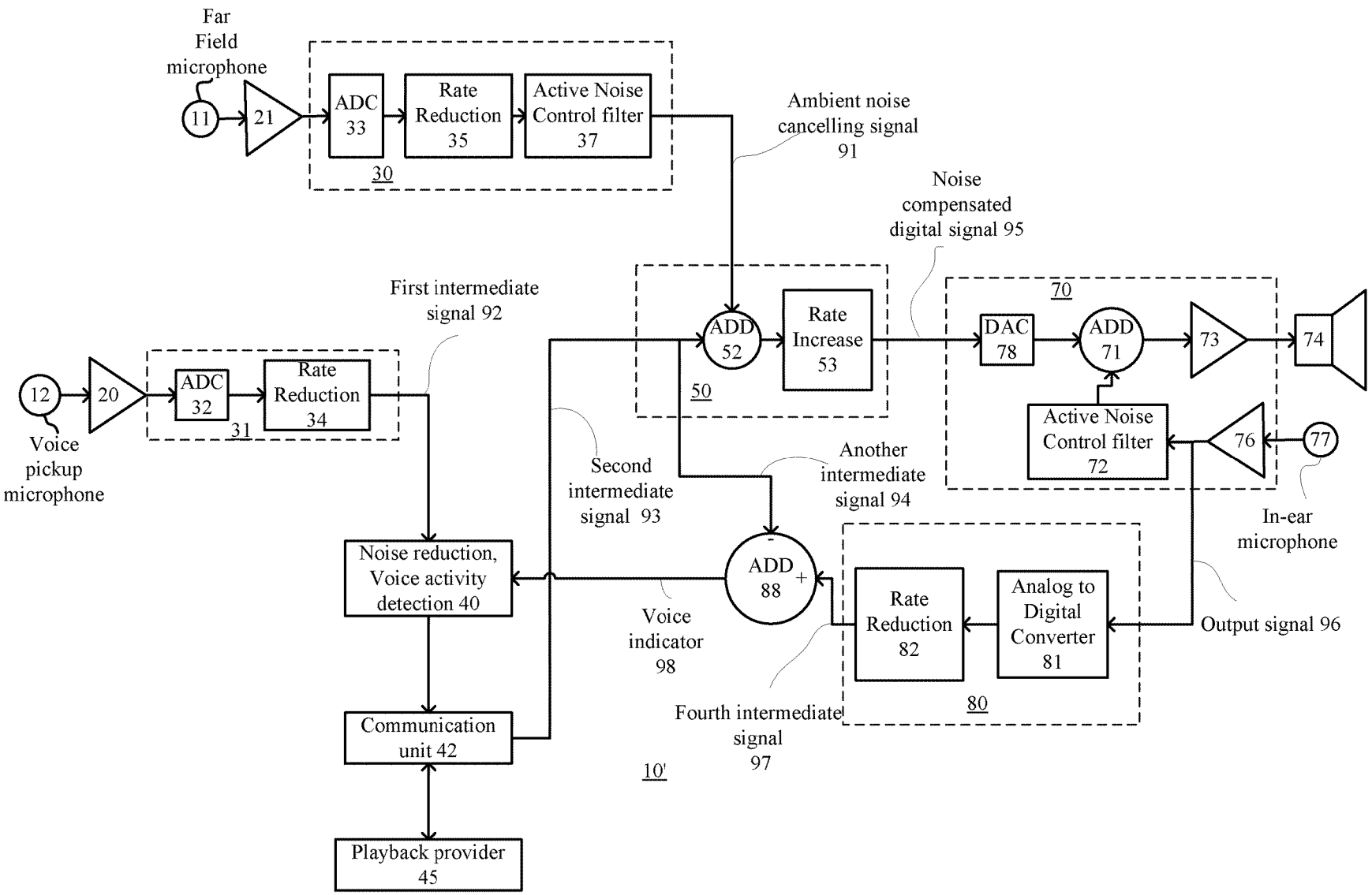
FIG. 3 illustrates a device according to an embodiment of the invention.

FIG. 3 illustrates device 10' that differs from device 10 of FIG. 1 by the following: (a) there is no first adder 51, (b) the output of second processing unit 31 is fed to noise reduction and/or (VAD) unit 40—and not to playback unit 50.

Thus—the signals from the second processing unit 31 (that represent signals detected by voice pickup microphone 12) are not fed to the feedback path of device 10'.

The second processing unit 31 is connected to the noise reduction and/or voice activity detector (VAD) unit 40 and provides the first intermediate signal 92 (also referred to as voice pickup or pickup signal) as input, which is then cleaned by the noise reduction and/or voice activity detector (VAD) unit 40 and sent to the communication unit.

The noise reduction and/or voice activity detector (VAD) unit 40 now outputs to the communication unit two different types of output:

a. A processed version of the first intermediate signal that uses the voice indicator to process the signal that is sent to the communication unit.

b. A message that the user speaks, according to the voice indicator signal.

It should be noted that the far field microphone may be any microphone that is configured to pickup ambient audio.

It should be noted that the in-ear microphone may be a microphone that is configured to pickup the audio content that is heard by a user in proximity (for example few centimeters to few millimeters) to said user's ear canal, and can be located within the ear canal or outside the ear canal.

The speaker 74 may be located within the ear canal of in proximity to the ear canal.

Any of the devices may be a headphone that may be located in various positions—for example "in ear", "over-the-ear" or may be "on-ear"

At least some (or even all) of the filters and/or processing units described above may be implemented as analog or digital, in hardware or in software. For example—the first processing unit 3) may be analog, the active noise control filter 72 may be digital. It should be noted that the signals from any of the microphones may be analog and appropriate analog to digital conversions may be applied before digital processing. Analog processing may be preceded (when required) by digital to analog converters.

The far field microphone 11 and the voice pickup microphone 12 may differ from each other by maybe the same microphone.

The first and second processing units 30 and 31 may be the same processing unit and/or may share some or all of their functionality in generating the ambient noise cancellation signal 91 and the first intermediate signal 92 respectively.

The ambient noise cancelling signal and the first intermediate signal 92 may be the same signal.

Rate Reduction operations and/or Rate Increase operations may not be required in some embodiments and in other embodiments additional rate change operations may be required.

Figure 4:
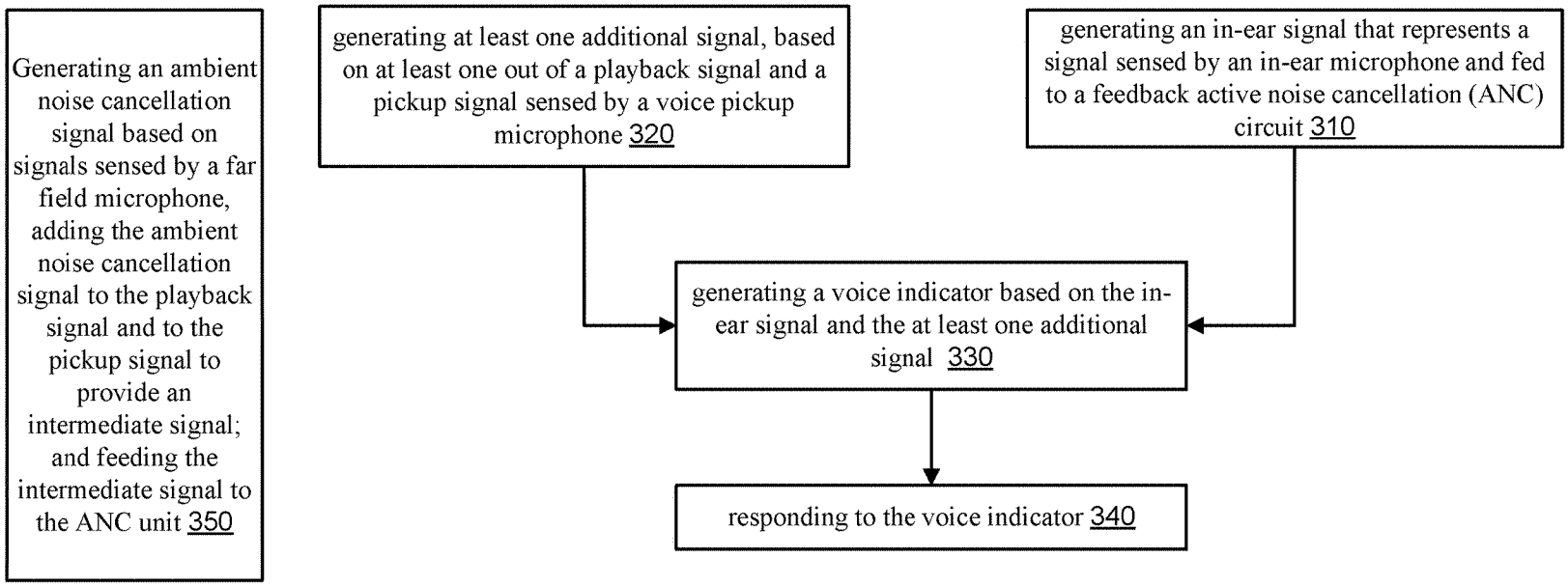
FIG. 4 illustrates a method according to an embodiment of the invention.

Amplifiers described may not be required in some embodiments and in other embodiments additional amplifiers may be required. Adders described may be analog adders and/or digital adders as the embodiment requires and/or may be omitted and/or two or more adders combined into multiple-input adders FIG. 4 illustrates method 300.

Method 300 may start by steps 310 and 320.

Step 310 may include generating an in-ear signal that represents a signal sensed by an in-ear microphone and fed to a feedback active noise cancellation (ANC) circuit.

For example—the in-ear signal may be the third intermediate signal 96 or fourth intermediate signal 97.

Step 310 may include receiving an analog in-ear signal from the ANC circuit; and analog to digital converting the analog in-ear signal to provide a digital in-ear signal.

Step 310 may include at least one out of amplifying, analog to digital converting, rate reduction, filtering, adding, subtracting, and the like.

Step 320 may include generating at least one additional signal, based on at least one out of a playback signal and a pickup signal sensed by a voice pickup microphone and/or a far field microphone.

For example—an additional signal may be first intermediate signal 92, the second intermediate signal 93, and the like.

Step 320 may include generating a playback signal and a pickup signal, generating a playback signal and not a pickup signal, generating a pickup signal and not a playback signal, and the like.

The generating may include amplifying, analog to digital conversion, rate reduction, adding, subtracting, filtering, and the like.

Steps 310 and 320 may be followed by step 330.

Step 330 may include generating a voice indicator based on the in-ear signal and the at least one additional signal.

Step 330 may include subtracting, from the in-ear signal, a sum of the playback signal to the pickup signal to provide the voice indicator.

Step 330 may include subtracting, from the in-ear signal, the playback signal to provide the voice indicator Step 330 may be followed by step 340 of responding to the voice indicator.

Step 340 may include at least one out of validating the voice indicator by a voice activity detection unit. For example—checking if the voice indicator is reliable enough to indicate of a voice signal.

Step 340 may include initiating a speech recognition process following a successful validation of the voice indicator.

Step 340 may include generating an alert following a successful validation of the voice indicator.

Method 300 may also include step 350 of generating an ambient noise cancellation signal based on signals sensed by a far field microphone, adding the ambient noise cancellation signal to the playback signal and to the pickup signal to provide an intermediate signal; and feeding the intermediate signal to the ANC unit.

Any one of steps 310 and 320 may include rate reduction.

The terms "including", "comprising", "having", "consisting" and "consisting essentially of" are used in an interchangeable manner.

In the foregoing specification, the invention has been described with reference to specific examples of embodiments of the invention. It will, however, be evident that various modifications and changes may be made therein without departing from the broader spirit and scope of the invention as set forth in the appended claims.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures may be implemented which achieve the same functionality.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A method for voice detection, the method comprises:

generating an in-ear signal that represents a signal sensed by an in-ear microphone and fed to a feedback active noise cancellation (ANC) circuit;

generating at least one additional signal, based on at least one out of a playback signal and a pickup signal sensed by a voice pickup microphone; and generating a voice indicator based on the in-ear signal and the at least one additional signal;

wherein at least one step out of the generating of the in-ear signal and the generating of the voice pickup signal comprises rate reduction for reducing a rate of signal outputted from an analog to digital converter.

2. The method according to claim 1 wherein the at least one additional signal is based on the playback signal and on the pickup signal.

3. The method according to claim 2 comprising subtracting, from the in-ear signal, a sum of the playback signal and the pickup signal to provide the voice indicator.

4. The method according to claim 1 wherein the at least one additional signal, is based on the playback signal and not on the pickup signal.

5. The method according to claim 1 wherein the generating of the voice indicator is followed by validating the voice indicator by a voice activity detection unit.

6. The method according to claim 5 comprising initiating a speech recognition process following a successful validation of the voice indicator.

7. The method according to claim 5 comprising generating an alert following a successful validation of the voice indicator.

8. A method for voice detection, the method comprises:

generating an in-ear signal that represents a signal sensed by an in-ear microphone and fed to a feedback active noise cancellation (ANC) circuit;

generating at least one additional signal, based on at least one out of a playback signal and a pickup signal sensed by a voice pickup microphone;

generating a voice indicator based on the in-ear signal and the at least one additional signal;

generating an ambient noise cancellation signal based on signals sensed by a far field microphone, adding, by a first adder, the playback signal and the pickup signal to provide a sum of the playback signal and the pickup signal;

adding, by a second adder, the ambient noise cancellation signal to the sum of the playback signal and the pickup signal to provide an intermediate signal;

feeding the intermediate signal to the feedback ANC unit; and wherein the generating of the voice indicator comprises subtracting, from the in-ear signal, the sum of the playback signal and the pickup signal to provide the voice indicator.

9. The method according to claim 8 wherein at least one step out of the generating of the in-ear signal and the generating of the voice pickup signal comprises rate reduction for reducing a rate of signals outputted from of an analog to digital converter.

10. The method according to claim 1 wherein the generating of the in-ear signal comprises:

receiving an analog in-ear signal from the ANC circuit; and analog to digital converting the analog in-ear signal by provide a digital in-ear signal.

11. A non-transitory computer readable medium that stores instructions for:

generating an in-ear signal that represents a signal sensed by an in-ear microphone and fed to a feedback active noise cancellation (ANC) circuit;

generating at least one additional signal, based on at least one out of a playback signal and a pickup signal sensed by a voice pickup microphone; and generating a voice indicator based on the in-ear signal and the at least one additional signal; wherein at least one step out of the generating of the in-ear signal and the generating of the voice pickup signal comprises rate reduction for reducing a rate of signals outputted from of an analog to digital converter.

12. The non-transitory computer readable medium according to claim 11 wherein the at least one additional signal, is based on the playback signal and on the pickup signal.

13. The non-transitory computer readable medium according to claim 12 that stores instructions for subtracting, from the in-ear signal, a sum of the playback signal and the pickup signal to provide the voice indicator.

14. The non-transitory computer readable medium according to claim 11 wherein the at least one additional signal, is based on the playback signal and not on the pickup signal.

15. The non-transitory computer readable medium according to claim 11 wherein the generating of the voice indicator is followed by validating the voice indicator by a voice activity detection unit.

16. The non-transitory computer readable medium according to claim 15 that stores instructions for initiating a speech recognition process following a successful validation of the voice indicator.

17. The non-transitory computer readable medium according to claim 15 that stores instructions for generating an alert following a successful validation of the voice indicator.

18. A non-transitory computer readable medium that stores instructions for:

generating an in-ear signal that represents a signal sensed by an in-ear microphone and fed to a feedback active noise cancellation (ANC) circuit;

generating at least one additional signal, based on at least one out of a playback signal and a pickup signal sensed by a voice pickup microphone; and generating a voice indicator based on the in-ear signal and the at least one additional signal;

generating an ambient noise cancellation signal based on signals sensed by a far field microphone, adding, by a first adder, the playback signal and the pickup signal to provide a sum of the playback signal and the pickup signal;

adding, by a second adder, the ambient noise cancellation signal to the sum of the playback signal and the pickup signal to provide an intermediate signal;

feeding the intermediate signal to the ANC unit; and wherein the generating of the voice indicator comprises subtracting, from the in-ear signal, the sum of the playback signal and the pickup signal to provide the voice indicator.

19. The non-transitory computer readable medium according to claim 18 wherein at least one step out of the generating of the in-ear signal and the generating of the voice pickup signal comprises rate reduction for reducing a rate of signals outputted from of an analog to digital converter.

20. The non-transitory computer readable medium according to claim 11 wherein the generating of the in-ear signal comprises:

receiving an analog in-ear signal from the feedback ANC circuit; and analog to digital converting the analog in-ear signal to provide a digital in-ear signal.

21. A device for voice detection, the device comprises:

an in-ear microphone;

a feedback active noise cancellation (ANC) circuit;

a voice pickup microphone;

a processing unit that is configured to generate an in-ear signal that represents a signal sensed by the in-ear microphone and fed to the feedback ANC circuit; wherein the processing unit comprises an analog to digital converter that is followed by a rate reduction unit configured to reduce a rate of signals outputted from of an analog to digital converter;

at least one other processing unit that is configured to:

generate at least one additional signal, based on at least one out of a playback signal and a pickup signal sensed by the voice pickup microphone; and generate a voice indicator based on the in-ear signal and the at least one additional signal.

22. The method according to claim 1 wherein the generating of the voice pickup signal comprises rate reduction for reducing a rate of signals outputted from of an analog to digital converter.

* * * * *